US011426670B2

(12) United States Patent
Kenney et al.

(10) Patent No.: US 11,426,670 B2
(45) Date of Patent: Aug. 30, 2022

(54) TOY VEHICLE BOOSTER

(71) Applicant: Mattel, Inc., El Segundo, CA (US)

(72) Inventors: Tyler Kenney, Sherman Oaks, CA (US); Andrey Cherednichenko, Los Angeles, CA (US); Chung Yau Fan, Hong Kong (CN); Hong Wang, Hong Kong (CN); An Rong Zhang, Shenzhen (CN)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 17/164,882

(22) Filed: Feb. 2, 2021

(65) Prior Publication Data

US 2021/0236948 A1 Aug. 5, 2021

Related U.S. Application Data

(60) Provisional application No. 62/969,292, filed on Feb. 3, 2020.

(51) Int. Cl.
*A63H 18/02* (2006.01)
*A63H 17/00* (2006.01)

(52) U.S. Cl.
CPC ..... *A63H 18/026* (2013.01); *A63H 17/008* (2013.01); *A63H 18/028* (2013.01)

(58) Field of Classification Search
CPC ..... A63H 18/026; A63H 18/00; A63H 18/02; A63H 17/008; A63H 29/00; A63H 18/028
See application file for complete search history.

(56) References Cited

U.S. PATENT DOCUMENTS

| | | | | |
|---|---|---|---|---|
| 49,698 A | | 9/1865 | Beach | |
| 2,602,262 A | | 7/1952 | Nichols | |
| 3,308,576 A | * | 3/1967 | Nadolny | A63H 18/12 446/446 |
| 3,559,335 A | * | 2/1971 | See | A63H 18/14 104/168 |
| 3,590,524 A | * | 7/1971 | Beny | A63H 18/14 104/168 |
| 3,600,850 A | | 8/1971 | Summerfield | |
| 3,622,158 A | | 11/1971 | Tepper | |
| 3,636,651 A | * | 1/1972 | Lohr | A63H 18/14 446/429 |
| 3,641,704 A | * | 2/1972 | Sims | A63H 18/14 124/78 |
| 3,667,672 A | | 6/1972 | Kennedy | |
| 3,712,615 A | | 1/1973 | Staats | |

(Continued)

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle booster is presented herein. The toy vehicle booster includes a booster assembly with linked booster wheels positioned on opposite sides of a track section. The booster's track section includes a central wall that defines two pathways between the linked booster wheels. Consequently, either one of the linked booster wheels can compress a first toy vehicle of a first size that is traveling within one of the two pathways against the central wall to accelerate the first toy vehicle through the track portion. Additionally or alternatively, the linked booster wheels can engage both sides of a second toy vehicle of a second size that is traveling along both of the two pathways to accelerate the second toy vehicle.

15 Claims, 14 Drawing Sheets

(56) References Cited

U.S. PATENT DOCUMENTS 3,734,404 A * 5/1973 Baynes ..... A63H 18/02 238/1 OE
3,777,394 A * 12/1973 Staats ..... A63H 18/005 446/487
3,789,542 A 2/1974 Sims
3,970,309 A * 7/1976 Sato ..... A63H 18/023 463/59
3,986,717 A 10/1976 Kirby
3,998,460 A 12/1976 Dyer
4,055,021 A 10/1977 Okamoto
4,174,587 A * 11/1979 Morin ..... A63H 18/026 74/543
4,221,076 A 9/1980 Ozawa
4,388,036 A * 6/1983 Okamoto ..... A63H 18/12 238/1 OF
4,697,812 A 10/1987 Rudell
5,868,599 A 2/1999 Kaufman
6,089,951 A 7/2000 Ostendorff
6,695,675 B1 * 2/2004 Ngan ..... A63H 17/008 446/444
6,793,554 B1 * 9/2004 Newbold ..... A63H 18/16 446/444
7,387,559 B2 6/2008 Sanchez-Castro
7,637,796 B2 12/2009 Hippely
7,955,158 B2 * 6/2011 Filoseta ..... A63H 18/14 446/444
8,366,508 B2 2/2013 Filoseta
2004/0198166 A1 10/2004 Newbold
2004/0238655 A1 12/2004 Monk
2006/0141902 A1 6/2006 Sinisi
2007/0149090 A1 * 6/2007 Hippely ..... A63H 18/026 446/445
2009/0253349 A1 * 10/2009 Iwakoshi ..... A63H 17/26 446/429
2011/0014850 A1 * 1/2011 Kennedy ..... A63H 17/14 446/465
2011/0250822 A1 10/2011 Koehl
2015/0097043 A1 4/2015 Lau
2019/0060772 A1 2/2019 Hamel

* cited by examiner

TOY VEHICLE BOOSTER

CROSS REFERENCE TO RELATED APPLICATIONS

This application claims priority to and is based on U.S. Patent Application No. 62/969,292, filed Feb. 3, 2020, entitled "Toy Vehicle Booster," the entire disclosure of which is incorporated herein by reference.

FIELD OF THE INVENTION

The present application relates generally to toy vehicles and, in particular, to a toy vehicle booster and/or a toy vehicle track including a booster.

BACKGROUND

Conventional toy vehicle track sets include one or more sections of track along which a toy vehicle can travel. In some track sets, accessories, such as boosters, will act on a toy vehicle as, before, or after the toy vehicle is traveling along the track. However, children often grow tired of playing with the same accessories and/or with the same toy vehicles. Consequently, toy vehicle accessories, such as boosters, that provide new and interesting play features are continuously desired.

SUMMARY

A toy vehicle booster is presented herein. According to one example embodiment, the toy vehicle booster includes a booster assembly with linked booster wheels positioned on opposite side of a track section. The booster's track section includes a central wall that defines two pathways between the linked booster wheels. Consequently, either one of the linked booster wheels can compress a first toy vehicle of a first size (e.g., a HOT WHEELS die-cast vehicle) against the central wall to accelerate the first toy vehicle through the track portion as the first toy vehicle is traveling along one of the two pathways. Additionally or alternatively, the linked booster wheels can engage both sides of a second toy vehicle of a second size, larger than the first size (e.g., a monster truck), to accelerate the second toy vehicle as the second toy vehicle travels along both of the two pathways (e.g., with left wheels in a first pathway and right wheels in a second pathway).

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy vehicle booster presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle booster. In the figures, like-referenced numerals designate corresponding parts throughout the different views.

DETAILED DESCRIPTION

Figure 1:
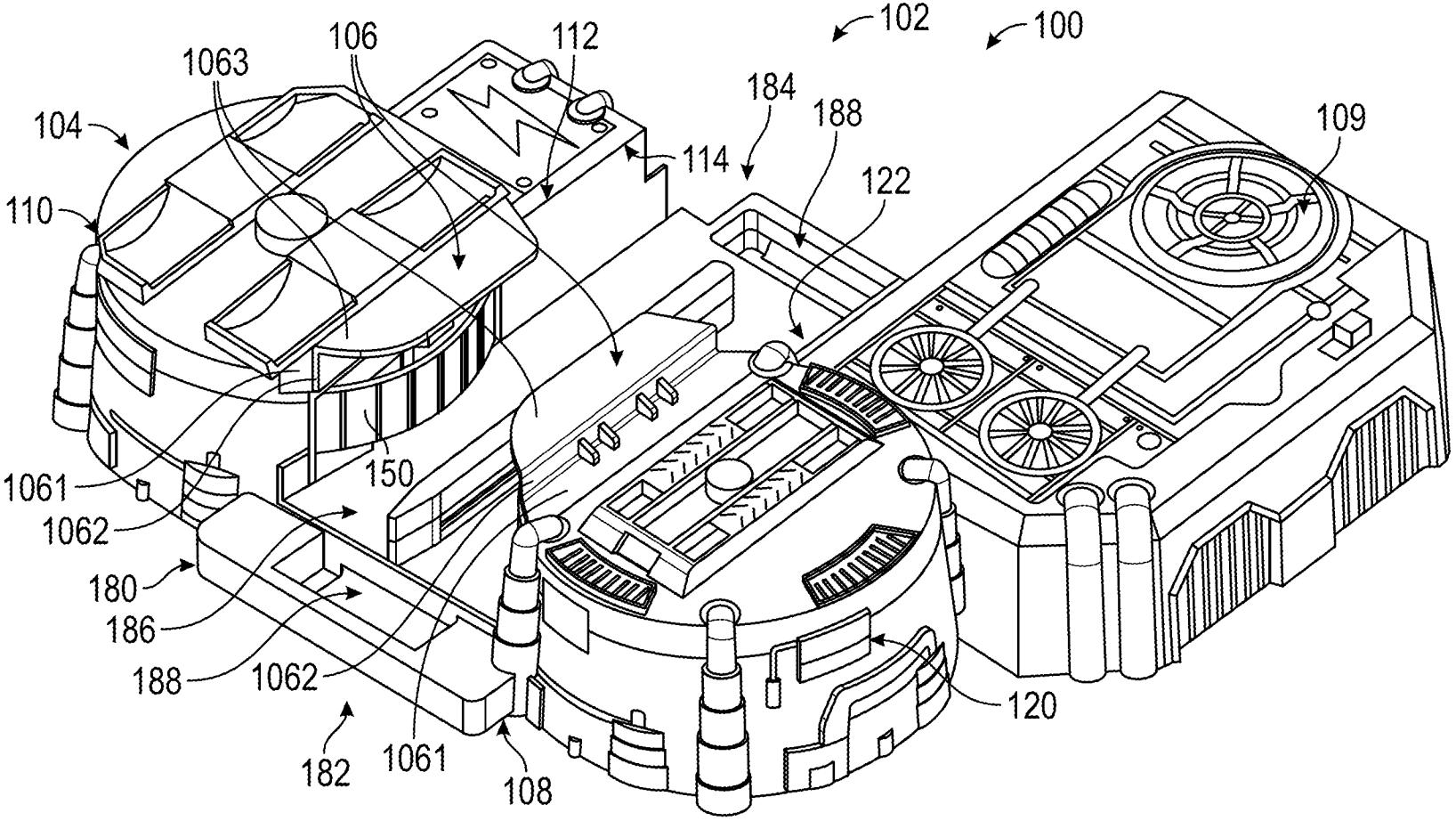
FIG. 1 illustrates a top perspective view of a toy vehicle booster formed in accordance with an example embodiment of the present application.

Overall, a toy vehicle booster is presented herein. The toy vehicle booster includes a booster assembly with booster wheels positioned on opposite side of a track section. The booster's track section includes a central wall that defines two pathways between the booster wheels. The pathways are parallel pathways and are each sized to receive a toy vehicle of a first size or scale. Consequently, one of the booster wheels can act on a first toy vehicle of a first size (e.g., a HOT WHEELS die-cast vehicle of a first scale) that is traveling within one of the two pathways to accelerate the first toy vehicle through the track portion. Additionally or alternatively, the booster wheels can engage both sides of a second toy vehicle of a second size (e.g., a monster truck) that is traveling along both of the two pathways (e.g., with left wheels in a first pathway and right wheels in a second pathway) to accelerate the second toy vehicle.

FIGS. 1-5 illustrate an example embodiment of the toy vehicle booster presented herein. The booster 100 includes a housing 102 which includes or defines a booster housing 104, a base portion 108, an electronics compartment 109, and a track section 180. In at least some embodiments, the booster housing 104, either alone or in combination with the base portion 108, defines the track section 180. For example, in the depicted embodiment, the booster housing 104 includes a first booster housing 110 and a second booster housing 120 that define an overall width W2 (see FIG. 2) of the track section 180 between an inner side wall 112 of the first booster housing 110 and an inner side wall 122 of the second booster housing 120. Meanwhile, the base portion 108, and in particular an upper side 144 of base portion 108, defines a track surface 186 of the track section 180 (e.g., a bottom of the track section 180).

Additionally, the first booster housing 110 and the second booster housing 120 collectively house a booster wheel assembly 150 on opposite sides of the track section 180. The base portion 108 may also house or cover portions of the booster wheel assembly 150 while the electronics compartment 109 may house or cover a battery receptacle and/or electronics, such as a controller, that are configured to operate electro-mechanical components of toy vehicle booster 100. However, in other embodiments, electronic components and/or batteries could also be housed within the booster housing 104, the base portion 108, and/or any other portion of housing 102.

Figure 3:
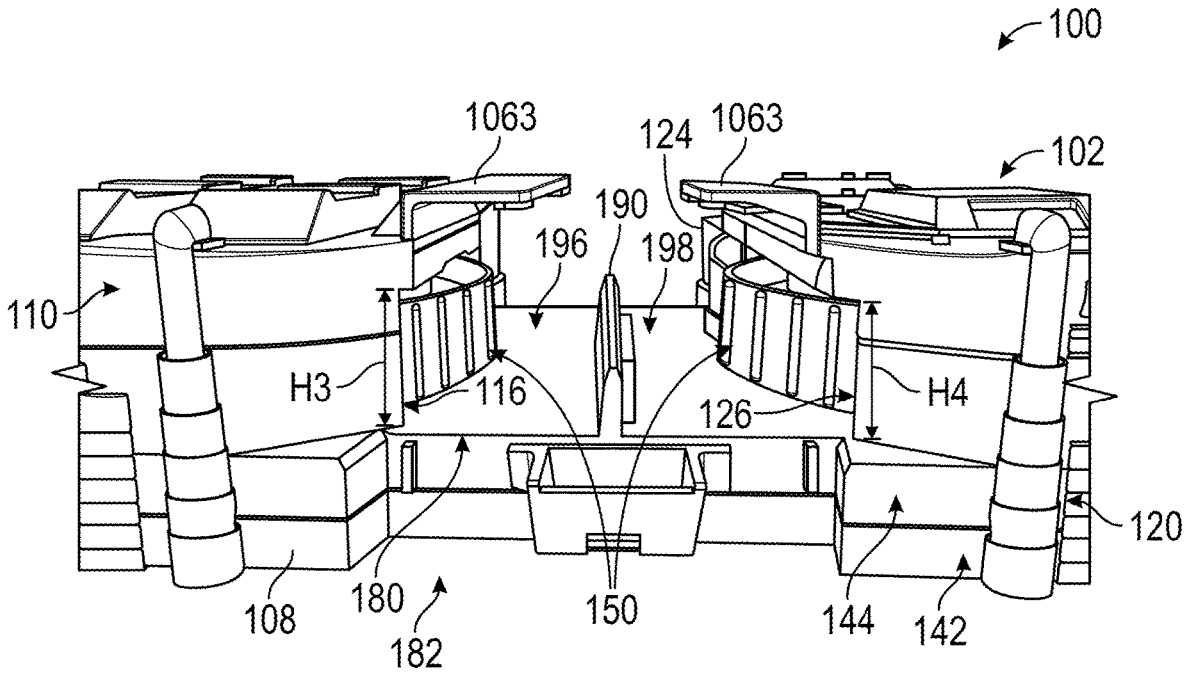

As can be seen in at least FIGS. 1 and 3, the inner side wall 112 of booster housing 110 and the inner side wall 122 of second booster housing 120 each include openings to allow the booster wheel assembly 150 to extend inwards into the track section 180. In particular, the inner side wall 112 of the first booster housing 110 includes a booster wheel opening 116 and the inner side wall 122 of the second booster housing 120 includes a booster wheel opening 126. A first booster wheel 152 (see FIGS. 4 and 5) extends through booster wheel opening 116, beyond an exterior surface 114 of the inner side wall 112, into the track section 180. Similarly, a second booster wheel 162 (see FIGS. 4 and 5) extends through booster wheel opening 126, beyond an exterior surface 124 of the inner side wall 122, into the track section 180. Put another way, the exterior surface 114 of the inner side wall 112 and the exterior surface 124 of the inner side wall 122 define the sides, or peripheral/lateral edges of the track section 180 and the first booster wheel 152 and second booster wheel 162 extend inwardly into the track section 180 from the peripheral/lateral edges of track section 180.

Figure 2:
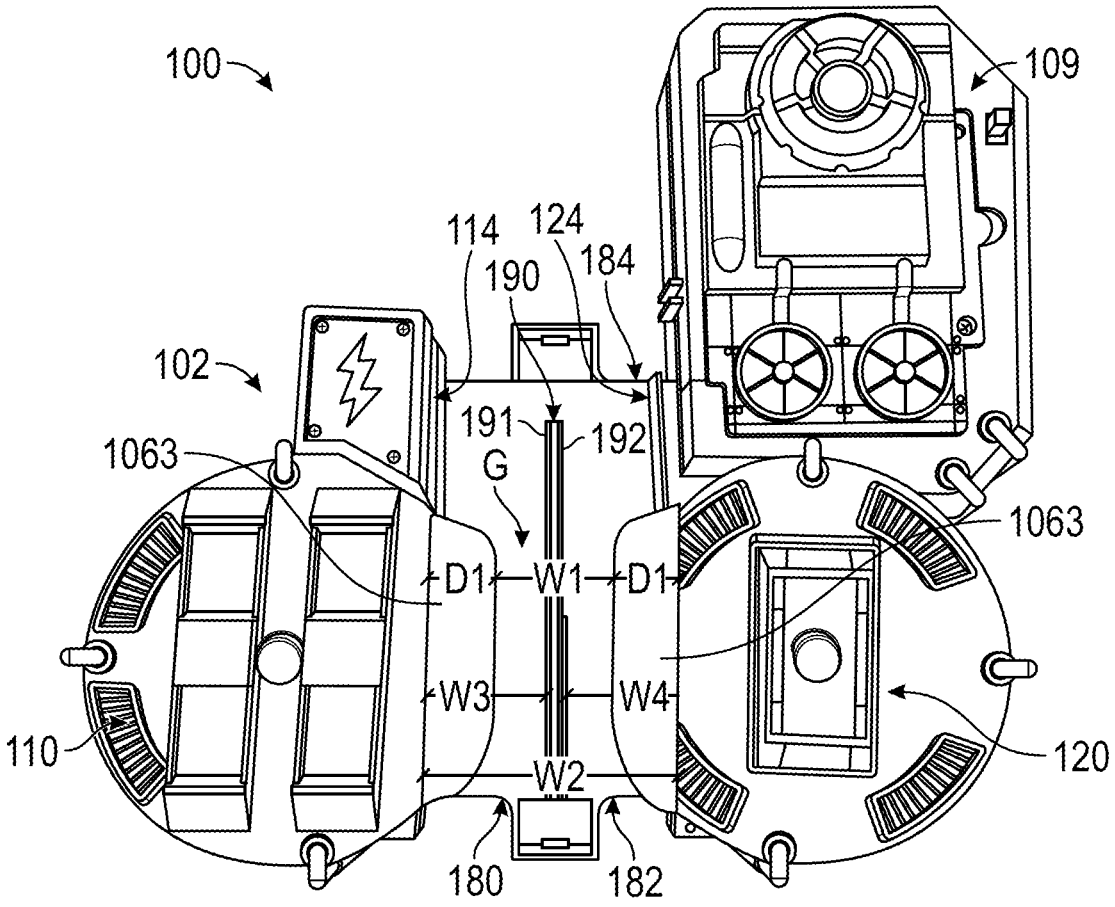
FIGS. 2 and 3 illustrate a top view and a back view, respectively, of the toy vehicle booster of FIG. 1.

Additionally, and now referring to FIGS. 1-3, in the depicted embodiment, track coverings 106 also extend inwardly from the peripheral/lateral edges of the track section 180. In particular, the coverings 106 extend over the track section 180, from top surfaces of the first booster housing 110 and the second booster housing 120 to at least partially cover the track section 180. That is, track coverings 106 may define, at least in part, a top of the track section 180. More specifically, and as can be seen in at least FIG. 1, each of coverings 106 includes a base portion 1061 that extends along a top of its respective booster housing 110, 120, a vertical extension 1062 that extends upwards from its base portion 1061, and an overhang portion 1063 that extends laterally inwards from the vertical extension 1062. Thus, each of the overhang portions 1063 covers or overhangs a portion of the track section 180.

In the depicted embodiment, the base portion 1061 is flat with respect to a horizontal plane, the vertical extension 1062 extends perpendicularly from the base portion 1061, and the overhang portion 1063 extends perpendicular from the vertical extension 1062. Thus, the overhang portions 1063 extend a distance D1 substantially horizontally beyond the inner side wall 112 of the first booster housing 110 and beyond the inner side wall 122 of the second booster housing 120, as can be seen in FIG. 2. Notably, in the depicted embodiment, the distances D1 do not span the entire width W2 of track section 180; instead, a gap "G" of a width W1 (see FIG. 2) is defined between terminal or distal ends of the overhang portions 1063. However, in other embodiments, the coverings 106 may be any shape or size and may be arranged or oriented in any manner and may or may not define a gap G. For example, the overhang portions 1063 might be stepped or angled to define areas of different heights instead of defining a gap G.

Still referring to FIGS. 1-3, the track section 180 of the booster 100 may extend from a first end 182 (e.g., an entrance end) to a second end 184 (e.g., an exit end) and, as mentioned, may have an overall width W2. The track section 180 includes a track surface 186 that is divided, by a central wall 190, into a first track pathway 196 and a second track pathway 198. The first track pathway 196 and the second track pathway 198 each extend from the first end 182 to the second end 184 and define surfaces along which one or more toy vehicles can travel (e.g., roll). In some embodiments, the track surface 186 of the track section 180 is defined by the base portion 108 of the booster 100. Additionally or alternatively, the track surface 186 may defined by the booster housing 104 or one or more separate track pieces attached to the booster housing 104 and/or the base portion 108.

In the depicted embodiment, the first track pathway 196 and the second track pathway 198 are substantially straight and parallel. That is, the central wall 190 is a substantially straight wall that extends parallel to the exterior surfaces 114 and 124 of booster housings 110 and 120, and the first track pathway 196 and the second track pathway 198 are defined by opposite sides of the central wall 190. In particular, the first track pathway 196 is defined as a straight pathway between a first side 191 of the central wall 190 and the exterior surface 114 (or the first booster wheel 152) of the first booster housing 110. Meanwhile, the second track pathway 198 is defined as a straight pathway between a second side 192 of the central wall 190 and the exterior surface 124 (or the second booster wheel 162) of the second booster housing 120. However, in other embodiments, first track pathway 196 and second track pathway 198 may each have any shape (e.g., central wall 190 may be curved or irregularly shaped) and may each extend in any direction.

Moreover, in the depicted embodiment, the first track pathway 196 and the second track pathway 198 have substantially similar dimensions. That is, a width W3 of first track pathway 196 (defined between first side 191 and inner side wall 112) is approximately equal (e.g., within 1 cm, within 5 cm, or within a range under 1 cm) to a width W4 of the second track pathway 198 (defined between second side 192 and the inner side wall 122). Additionally, the first track pathway 196 has a height H3 (defined between the track surface 186 of the first track pathway 196 and a bottom of the overhang portion 1063 of track coverings 106) that is approximately equal to a height H4 of the second track pathway 198 (defined between the track surface 186 of the second track pathway 198 and a bottom of the overhang portion 1063 of track coverings 106). However, in other embodiments, first track pathway 196 and second track pathway 198 may have any desirable dimension. For example, the first track pathway 196 may be wider than the second track pathway 198 or vice versa.

Additionally, in the depicted embodiment, the first end 182 and the second end 184 each include or define one or more connectors 188. For example, the connector 188 included or defined at the first end 182 may be a male connector and the connector 188 included or defined at the second end 184 may be a female connector. However, in other embodiments, any connectors, whether mechanical and/or electrical, can be included at the first end 182 and the second end 184 so that track pieces now known or developed hereafter can be connected to the track section 180 (e.g., via snap fit connections).

Figure 4:
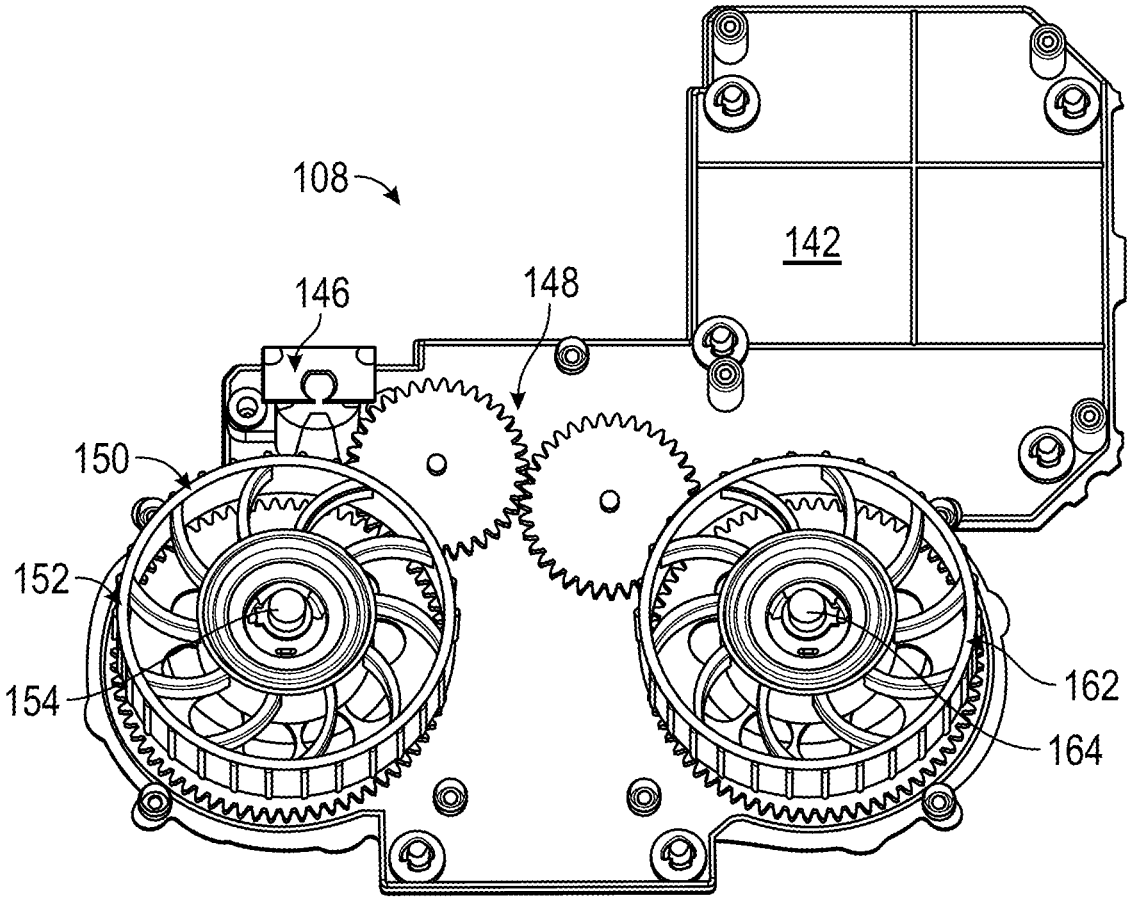
FIG. 4 illustrates a sectional view of the toy vehicle booster of FIG. 1 showing interior components of the toy vehicle booster.
Figure 5:
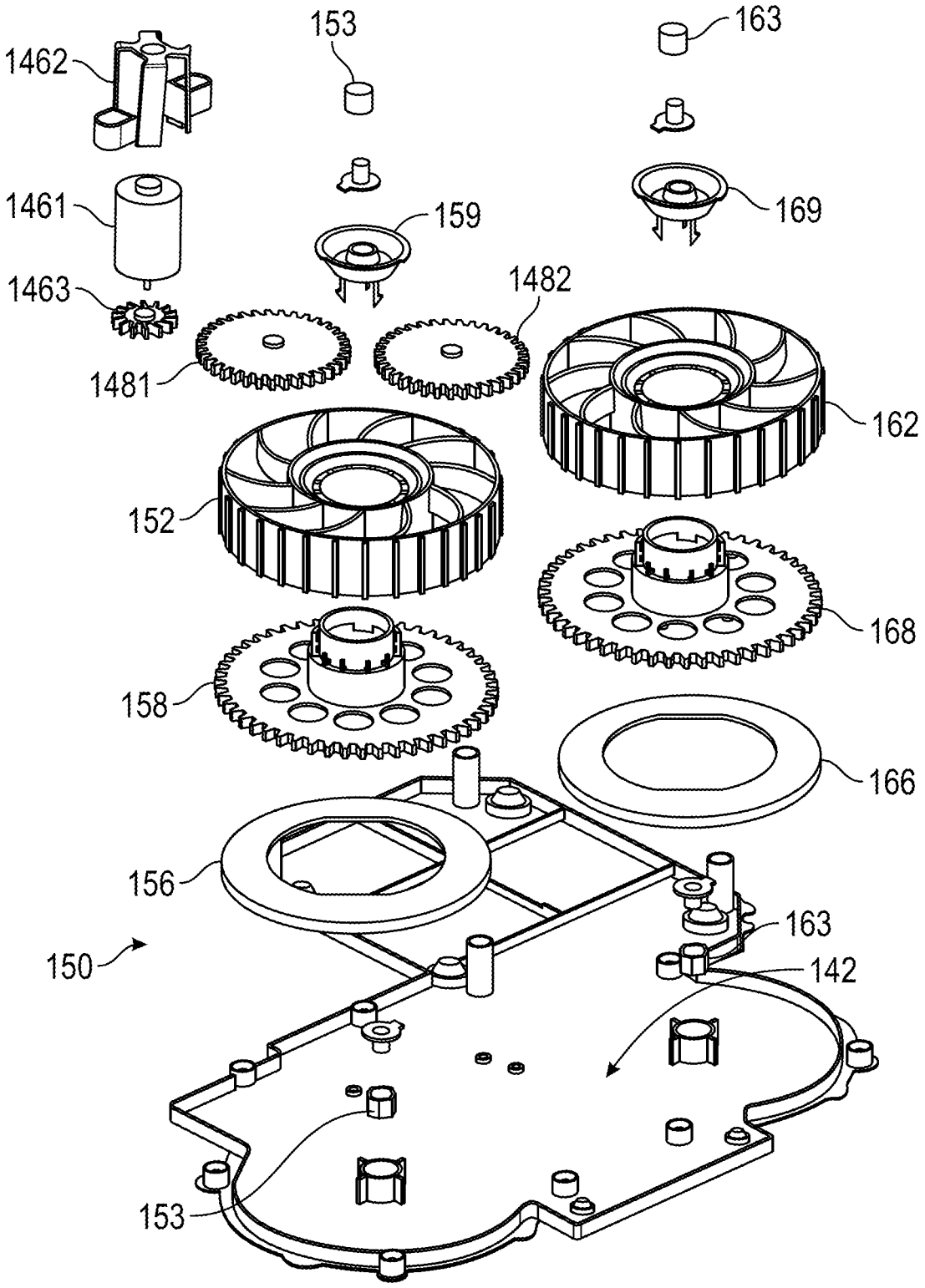
FIG. 5 is an exploded view of the interior components shown in FIG. 4.

Now turning specifically to FIGS. 4 and 5, in the depicted embodiment the booster wheel assembly 150 is mounted primarily on a lower side 142 of the base portion 108. Additionally, in the depicted embodiment, at least a portion of the booster wheel assembly 150 is covered by an upper side 144 (see FIG. 3) of the base portion 108, which, in at least some embodiments, may also define the track surface 186 of the track section 180. Moreover, in the depicted embodiment, a motor assembly 146 is mounted on and/or between the lower side 142 of the base portion 108 and the upper side 144 of the base portion 108. In at least some embodiments, any electronic components in the motor assembly 146 and/or the booster wheel assembly 150 (e.g., motor 1461) can be powered by and/or controlled by components (e.g., controllers and/or batteries) housed in the electronics compartment 109.

As can be seen in FIG. 5, in the depicted embodiment, the booster wheel assembly 150 includes two booster wheels: first booster wheel 152 and second booster wheel 162. The first booster wheel 152 is coupled to, connected to, and/or mounted on a first booster wheel gear 158 and a first flywheel 156, and each of these components are mounted on a first post 154 so that the components can rotate together around the first post 154. For example, a first wheel holder 159 may secure the first booster wheel 152 to the first booster wheel gear 158 and first bushings 153 may allow the first booster wheel 152, the first booster wheel gear 158, and the first flywheel 156 to rotate together about the first post 154 (e.g., rotate as a unit). Similarly, the second booster wheel 162 is coupled to, connected to, and/or mounted on a second booster wheel gear 168 and a second flywheel 166, and each of these components are mounted on a second post 164 so that the components can rotate together around the second post 164. For example, a second wheel holder 169 may secure the second booster wheel 162 to the second booster wheel gear 168 and first bushings 163 may allow the second booster wheel 162, the second booster wheel gear 168, and the second flywheel 166 to rotate together about the second post 164 (e.g., rotate as a unit). However, these components are merely examples and, in other embodiments, booster wheel assembly 150 may include any desired components to allow rotation of booster wheels 152 and 162.

Still referring to FIG. 5, in the depicted embodiment, the motor assembly 146 includes a motor 1461, a motor holder 1462, and a drive gear 1463. The motor holder 1462 supports the motor 1461 in a position that allows/causes the motor 1461 to drive the drive gear 1463 which, in turn, drives a gear train 148 that is coupled to the booster wheel assembly 150. In this particular embodiment, the gear train 148 includes a first gear 1481 that imparts rotational motion of the motor assembly 146 to the first booster wheel 152 via first booster wheel gear 158. Additionally, the gear train 148 includes a second gear 1482 that imparts rotational motion of the motor assembly 146 to the second booster wheel 162 via second booster wheel gear 168.

At least because the first booster wheel 152 and the second booster wheel 162 are both driven by motor 1461, the first booster wheel 152 and the second booster wheel 162 may be referred to as linked booster wheels. However, the depicted manner in which the first booster wheel 152 and the second booster wheel 162 are linked is merely an example and, in other embodiments, the first booster wheel 152 and second booster wheel 162 may be linked in any desirable manner. For example, the first booster wheel 152 might be mounted on a first booster wheel gear 158 that is large enough to directly engage the second booster wheel gear 168 of the second booster wheel 162 (and only one of gears 158 and 168 might engage the motor assembly 146). As another example, booster wheels 152 and 162 could be linked via separate motors that are communicating via a wired or wireless connection. That is, booster wheels 152 and 162 might be electronically linked instead of mechanically linked. Still further, in some embodiments, booster wheels 152 and 162 need not be linked and can be operated at the same speed or different speeds.

In a preferred embodiment, the booster wheels 152 and 162 are linked to operate at the same speed so that they impart the same accelerating force to the toy vehicles passing through either the first track pathway 196 or second track pathway 198. In instances where multiple vehicles are racing against each other within a track set that includes the toy vehicle booster 100 (see, e.g., FIG. 14), it may be desirable that a toy vehicle does not gain an unfair advantage over other toy vehicles by passing through track section 180 using a particular track pathway versus the other track pathway. Additionally, having the booster wheels 152 and 162 operating at the same speed ensures that a toy vehicle sized to travel along the first track pathway 196 and second track pathway 198 simultaneously (see, e.g., FIG. 13) receives the same accelerating force on both sides of the toy vehicle and travels straight when exiting the booster 100. Put another way, having the booster wheels 152 and 162 operate at different speeds may, in certain instances, cause a toy vehicle traveling along the first track pathway 196 and second track pathway 198 simultaneously to spin when exiting the booster 100.

Moreover, although booster wheels 152 and 162 are generally depicted as hub-and-spoke like elements, it is to be understood that booster wheels 152 and 162 can have any shape, for example, to enhance flexibility, durability, grip, etc. and ensure that booster wheels 152 and 162 can accommodate and engage a toy vehicle passing along track section 180 to accelerate the toy vehicle (e.g., to "boost" the toy vehicle). The flexibility of booster wheels 152 and 162 may also allow the booster wheels 152 and 162 to accommodate toy vehicles of slightly varied widths. As one example, the booster wheels 152 and 162 may have an S-shape that allows the relative distance between the booster wheels 152 and 162 to change, as is disclosed in U.S. Pat. No. 7,955,158 to Filoseta et al., which is incorporated by reference in its entirety. Additionally or alternatively, the booster wheels 152 and 162 may have a plurality of apertures (instead of or in addition to the openings provided by the depicted hub-and-spoke like design), as is disclosed in U.S. Pat. No. 6,793,554 to Newbold, which is also incorporated by reference in its entirety.

Figure 6:
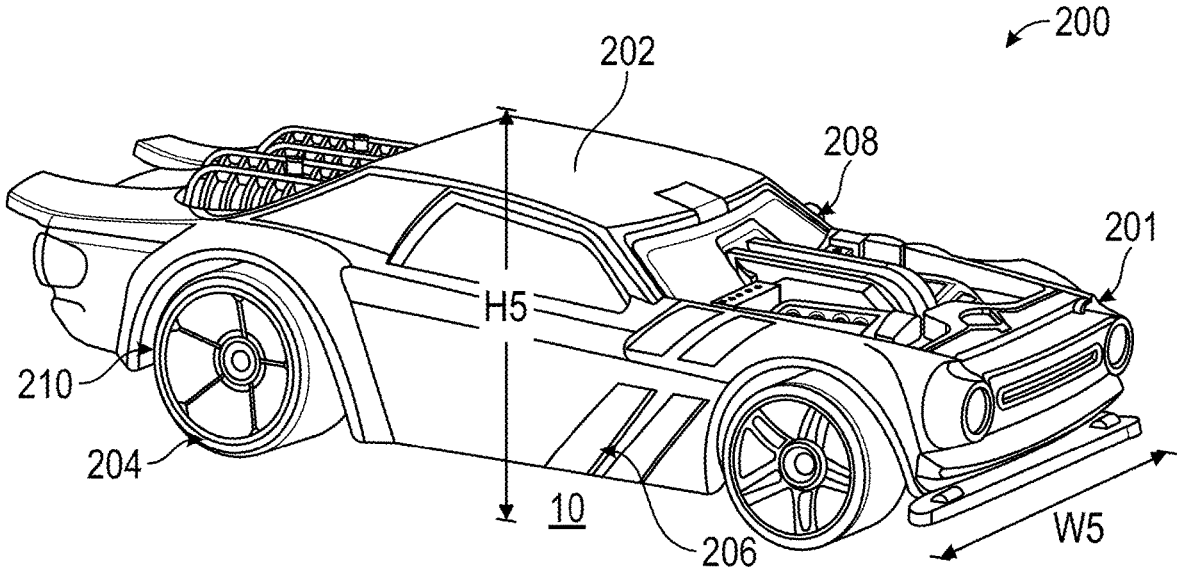
FIG. 6 illustrates a side perspective view of a toy vehicle of a first size that is usable with the toy vehicle booster presented herein.

Now turning to FIG. 6, this Figure depicts a toy vehicle 200 of a first scale or size that is usable with the toy vehicle booster presented herein. For example, the toy vehicle 200 may be a die-cast, small-scale model of a production car or a similarly sized vehicle, like a 1:64 scale toy vehicle produced and sold as HOT WHEELS or MATCHBOX toy vehicles. Generally, the toy vehicle 200 has an overall height H5 defined by its main body 201 and its wheels 210. That is, the toy vehicle 200 extends a height H5 above a support surface 10 on which it is resting (e.g., the ground or a track). Put still another way, the height H5 is measured from a bottom 204 of the toy vehicle 200 to a top 202 of the toy vehicle 200. In the depicted embodiment, the main body 201 is mounted atop wheels 210 and, thus, the wheels 210 define the bottom 204 of the toy vehicle 200 while the main body 201 defines the top 202 of the toy vehicle 200.

Additionally, the toy vehicle 200 has an overall width W5 measured from a first side 206 of the toy vehicle 200 to a second side 208 of the toy vehicle 200. In the depicted embodiment, the main body 201 extends laterally over the wheels 210 so that both the main body 201 and wheels 210 define the overall width W5; however, in other embodiments, the main body 201, the wheels 210, or any other portion of toy vehicle 200 can define the overall width W5 of the toy vehicle 200.

Figure 7:
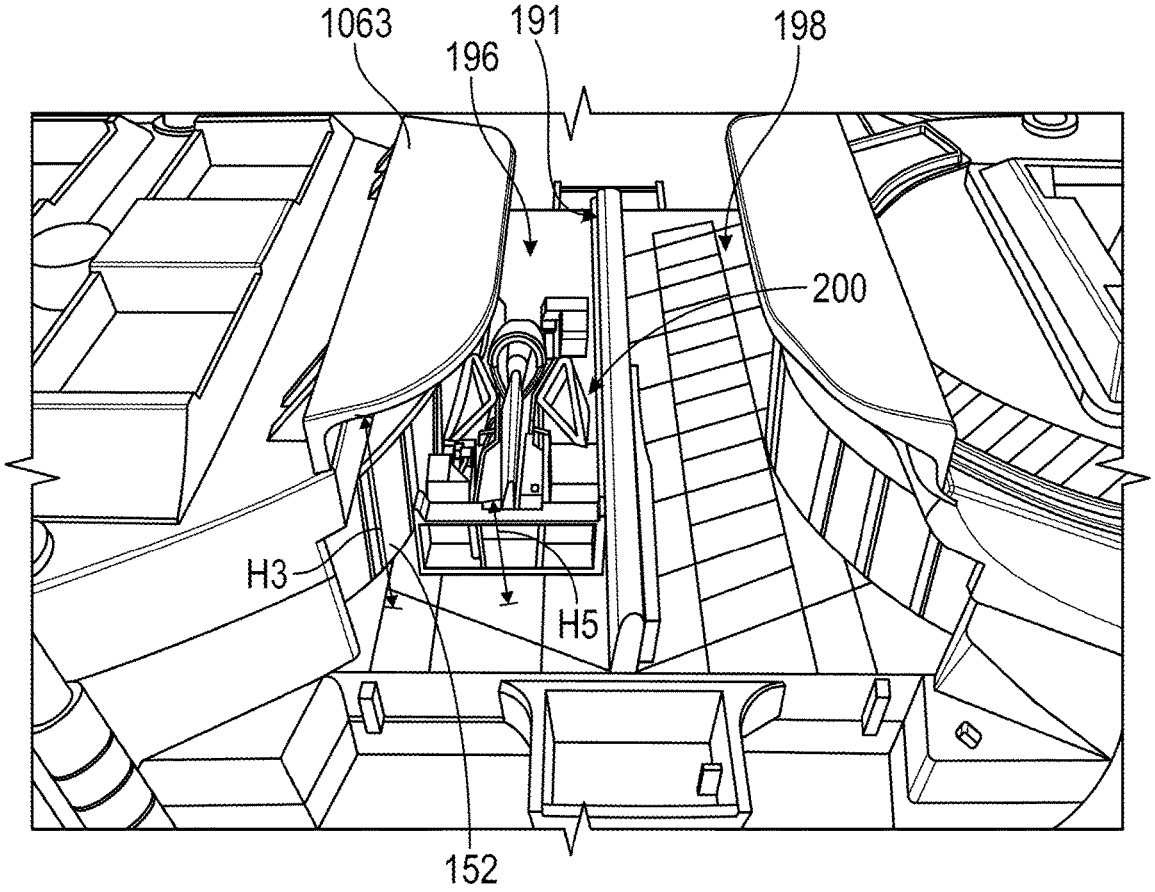
FIGS. 7-9 illustrate a back perspective view, a top perspective view, and a top view, respectively, of the toy vehicle of FIG. 6 in the toy vehicle booster of FIG. 1.
Figure 8:
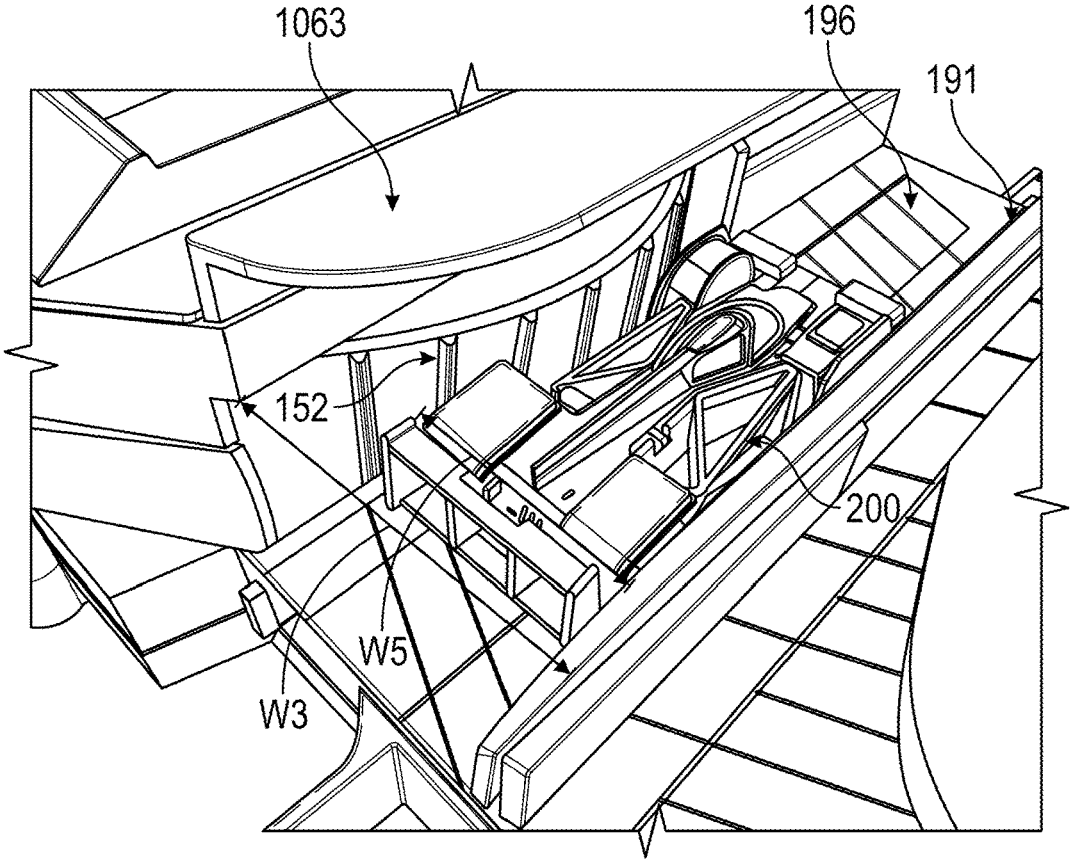
Figure 9:
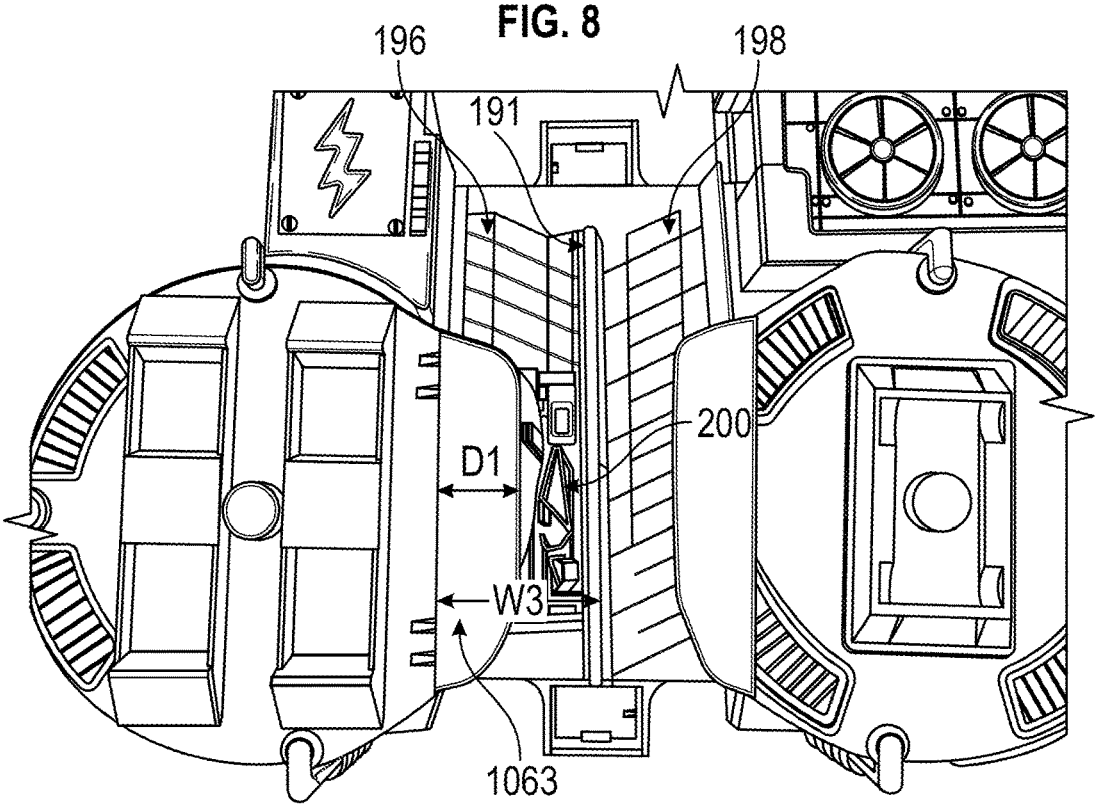

Now turning to FIGS. 7-9, the toy vehicle booster 100 is sized and arranged so that the toy vehicle 200 can traverse the track section 180 of the toy vehicle booster 100 in either the first track pathway 196 or the second track pathway 198. When the toy vehicle 200 enters the first track pathway 196 or the second track pathway 198, the booster wheel assembly 150 engages the toy vehicle 200 and compresses the toy vehicle 200 against the central wall 190 in order to impart rotational force to the toy vehicle 200 and accelerate the toy vehicle 200 along the track section 180. For example, in FIGS. 7-9, first booster wheel 152 engages the second side 208 of the toy vehicle 200 and compresses the first side 206 of the toy vehicle 200 against the first side 191 of the central wall 190 to impart force to the toy vehicle 200 and accelerate the toy vehicle 200 along the first track pathway 196. During this action, the covering 106 (and, in particular, the overhang portion 1063 of covering 106) may retain the toy vehicle 200 in the first track pathway 196. That is, covering 106 ensure that the compression does not force the toy vehicle 200 upwards and out of the first track pathway 196.

As can be seen in FIGS. 7-9, the toy vehicle 200 is able to enter and pass through first track pathway 196 because the overall width W5 of the toy vehicle 200 is smaller than the width W3 of the first track pathway 196 and because the overall height H5 of the toy vehicle 200 is smaller than the height H3 of first track pathway 196. That is, the overall width W5 of the toy vehicle 200 may allow the toy vehicle 200 to pass between the inner side wall 112 of the first booster housing 110 and the first side 191 of the central wall 190. Additionally, the first booster wheel 152 may flex or bend to accommodate the overall width W5. Meanwhile, the overall height H5 of the toy vehicle 200 may be small enough that at least a portion of the toy vehicle 200 can pass underneath the track covering 106, and in particular the overhang portion 1063 of the track covering 106, extending inwardly from the first booster housing 110.

In the depicted embodiment, the first track pathway 196 and the second track pathway 198 have the same dimensions (i.e., H3 equals H4 and W3 equals W4). Thus, although not shown, if the toy vehicle 200 were to enter the second track pathway 198 of the depicted embodiment, the second booster wheel 162 would engage the first side 206 of the toy vehicle 200 and compress the second side 208 of the toy vehicle 200 against the second side 192 of the central wall 190 to impart force to the toy vehicle 200 and accelerate the toy vehicle 200 along the second track pathway 198. During this action, the covering 106 (and, in particular, the overhang portion 1063 of covering 106) may retain the toy vehicle 200 in the second track pathway 198 (like it does for a vehicle in first track pathway 196). However, in at least some embodiments, first track pathway 196 may have different dimensions than second track pathway 198 so that the first track pathway 196 and the second track pathway 198 are each sized to receive and accelerate toy vehicles of specific sizes. For example, the first track pathway 196 might receive and accelerate toy vehicle 200 and second track pathway 198 might receive a miniature version of toy vehicle 200 (e.g., half the size).

Figure 10A:
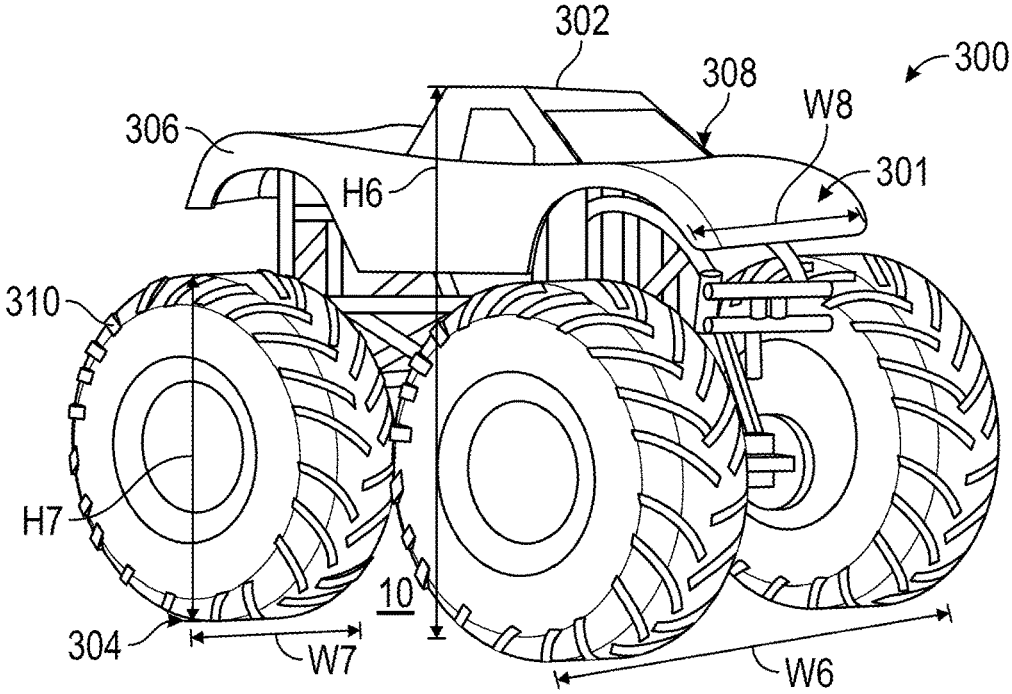
FIGS. 10A and 10B illustrate a side perspective view and a bottom perspective view of a toy vehicle of a second size that is usable with the toy vehicle booster presented herein.
Figure 10B:
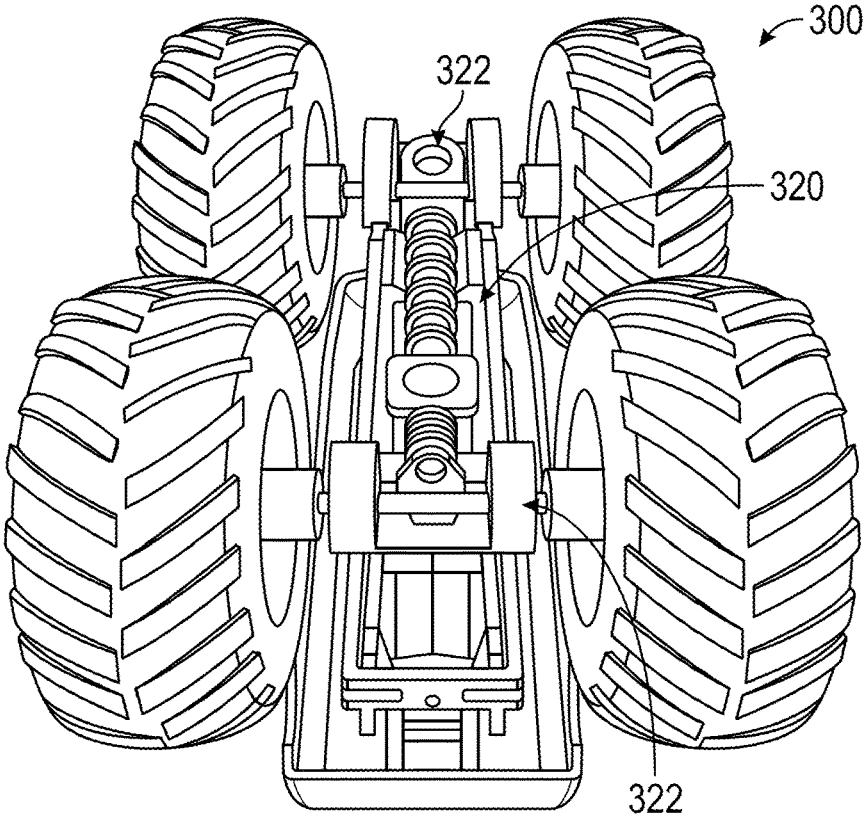

Now turning to FIGS. 10A-10B, these Figures depict a toy vehicle 300 of a second scale or size that is also usable with the toy vehicle booster presented herein. In at least some instances, the toy vehicle 300 is a die-cast, small-scale model of a monster truck or another such oversized vehicle (e.g., 1:64 scale monster truck). Alternatively, the toy vehicle 300 can be a die-cast, small-scale model of the same vehicle as toy vehicle 200, but sized at a larger scale (e.g., 1:43 instead of 1:64). In any case, the toy vehicle 300 has an overall height H6 that is larger than the overall height H5 of toy vehicle 200 (e.g., double) and the toy vehicle 300 has an overall width W6 that is larger than the overall width W5 of toy vehicle 200 (e.g., double).

In at least some embodiments, a majority of the size disparity between toy vehicles 200 and 300 can be attributed to the wheels 310 of the toy vehicle 300, which may be scaled versions of oversized wheels (e.g., monster truck wheels). For example, in the depicted embodiment, each of the wheels 310 also has its own width W7 and its own height H7 that are substantially smaller than the overall width W6 and overall height H6; however, width W7 and height H7 may be comparable in size to the overall width W5 and the overall height H5 of the toy vehicle 200. That said, in other embodiments, the wheels 310 and/or main body 301 of toy vehicle 300 may create the size disparity as compared to toy vehicle 200.

In the depicted embodiment, the overall width W6 of the toy vehicle 300 is defined by its wheels 310 (e.g., monster truck wheels), which are mounted to a first side 306 and a second side 308 of a main body 301 of the toy vehicle 300. Meanwhile, the overall height H6 is defined by the main body 301 and the wheels 310. That is, the toy vehicle 300 extends a height H6 above a support surface 10 on which it is resting (e.g., the ground or a track). Put still another way, the height H6 is measured from a bottom 304 of the toy vehicle 300 to a top 302 of the toy vehicle 300. In the depicted embodiment, the main body 301 extends above wheels 310 and, thus, the wheels 310 define the bottom 304 of the toy vehicle 300 while the main body 301 defines the top 302 of the toy vehicle 200. However, in other embodiments, the main body 301, the wheels 310, or any other portion of toy vehicle 200 can define the overall width W6 and/or the overall height H6 of the toy vehicle 300.

Still referring to FIGS. 10A and 10B, in the depicted embodiment, the main body 301 has a width W8 that spans from the first side 306 of the main body 301 to the second side 308 of the main body 301. The width W8 is smaller than the overall width W6 of the toy vehicle 300 so that the main body 301 sits between the wheels 310, or at least between the lateral edges of the wheels 310. Additionally, the main body 301 is coupled to the wheels 310 via a chassis 320 (see FIG. 10B). In at least some embodiments, the chassis defines one or more grooves 322 that can engage or ride on walls (e.g., slide or otherwise translate along), such as central wall 190, included in the toy vehicle booster 100 and/or a track set in which the toy vehicle booster 100 is included, an example of which is described below in connection with FIGS. 14-19.

Figure 11:
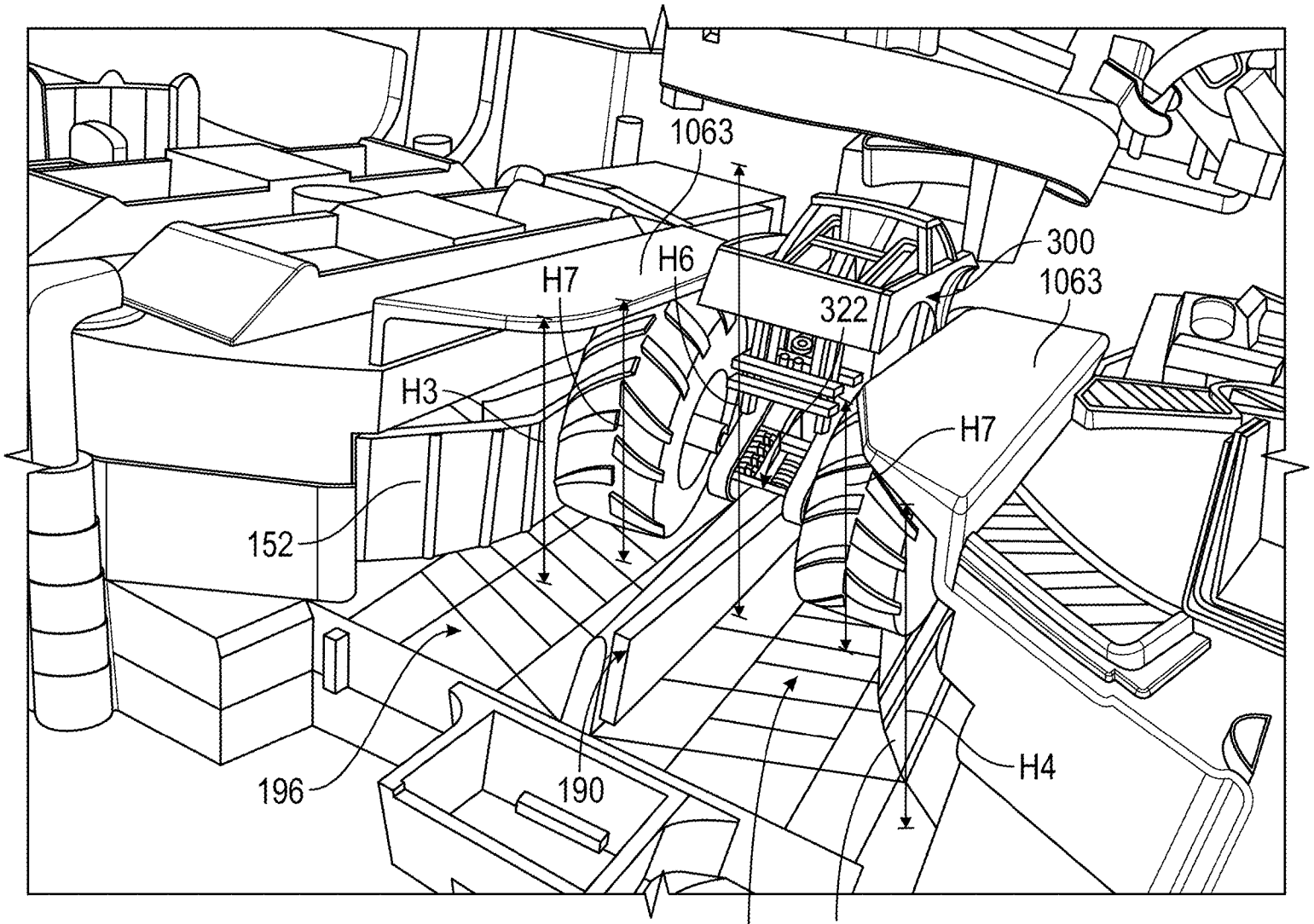
FIGS. 11-13 illustrate a back perspective, a back view, and a top perspective view, respectively, of the toy vehicle of FIGS. 10A and 10B in the toy vehicle booster of FIG. 1.
Figure 12:
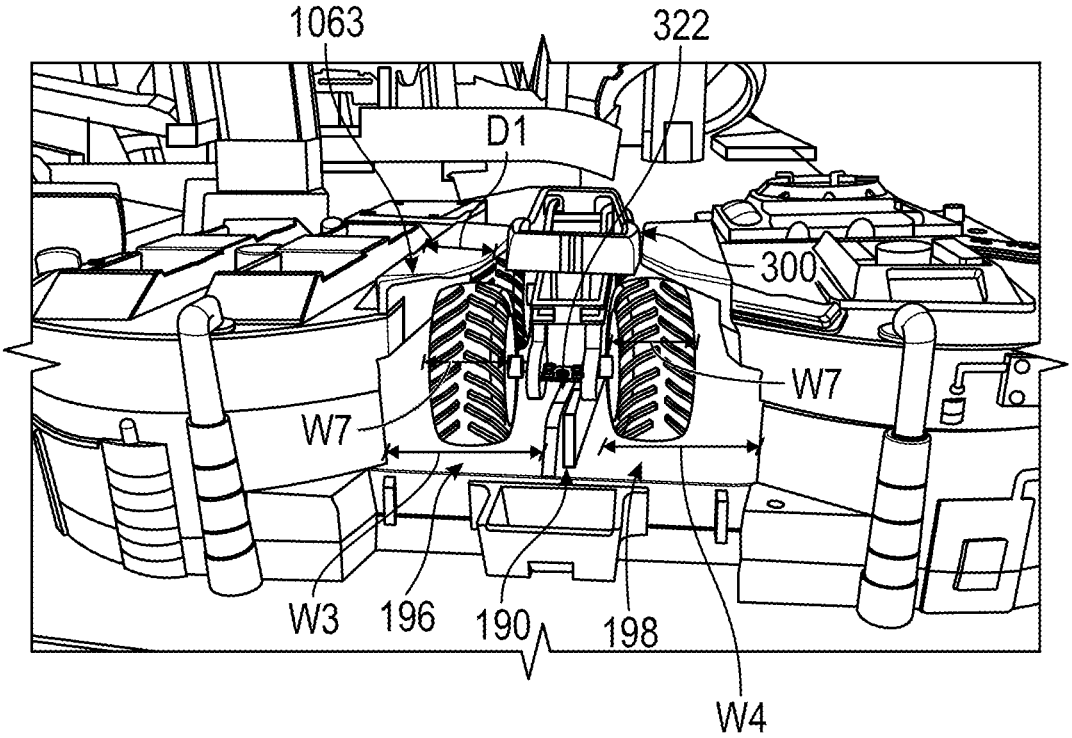
Figure 13:
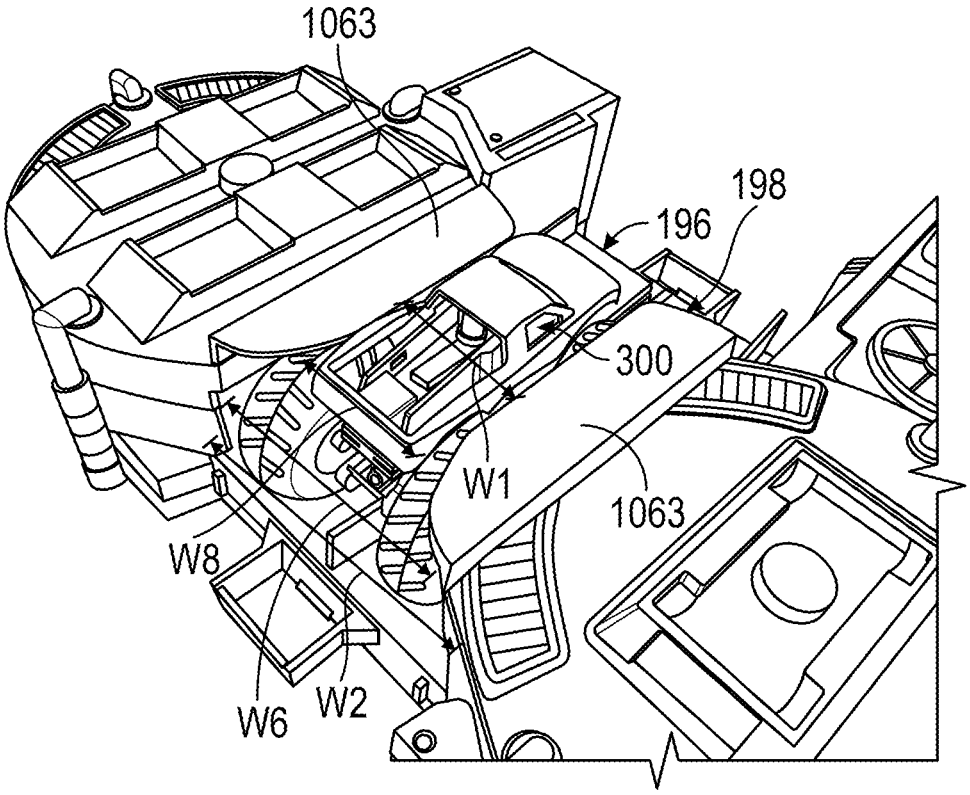

Now turning to FIGS. 11-13, the toy vehicle booster 100 is sized and arranged so that the toy vehicle 200 of the first size or the toy vehicle 300 of the second size can be accelerated by booster 100. In particular, due to the features of the toy vehicle booster 100, the toy vehicle 300 can traverse the track section 180 of the toy vehicle booster 100 by traveling along the first track pathway 196 and the second track pathway 198 simultaneously. When the toy vehicle 300 enters the first track pathway 196 and the second track pathway 198, the booster wheel assembly 150 engages both sides of the toy vehicle 300, compressing the toy vehicle 300 therebetween to impart rotational force to the toy vehicle 300 and accelerate the toy vehicle 300 along the track section 180. For example, in FIGS. 11-13, first booster wheel 152 engages wheels 310 disposed on a first side (the left side) of the toy vehicle 300 and second booster wheel 162 engages wheels 310 disposed on a second side (the right side) of the toy vehicle 300 so that booster wheels 152 and 162 can press against and impart force to the toy vehicle 300 (via wheels 310) to accelerate the toy vehicle 300 along the track section 180.

As can be seen in FIGS. 11-13, the toy vehicle 300 is able to enter and pass through first track pathway 196 and the second track pathway 198 because the overall dimensions of the toy vehicle 300 allow it to ride in the first track pathway 196 and the second track pathway 198 while also fitting beneath the track coverings 106. More specifically, the overall width W6 of the toy vehicle 200 is smaller than the overall width W2 of the track section 180 and the width W7 of each of the wheels 310 is smaller than both the width W3 of first track pathway 196 and the width W4 of second track pathway 198. Meanwhile, the height H7 of the wheels 310 is smaller than both the height H3 of first track pathway 196 and the height H4 of the second track pathway 198. Thus, the wheels 310 on one side of the toy vehicle 300 can ride in the first track pathway 196 beneath the overhang portion 1063 of a covering 106 while the wheels 310 on a second side of the toy vehicle 300 ride in the second track pathway 198 beneath the overhang portion 1063 of another covering 106. The covering 106 may, in at least some embodiments, encourage the wheels 310 to remain in contact with booster wheels 152 and 162 while booster wheels 152 and 162 are engaging and accelerating the toy vehicle 300 via wheels 310.

Still further, since the main body 301 of the toy vehicle 300 of the depicted embodiment extends above the coverings 106 (e.g., height H6 is taller than heights H3 and H4), the width W8 of the main body 301 is smaller than the width W1 of the gap G between the coverings 106. The main body 301 is also centered between the wheels 310 so that it aligns with the gap G when the toy vehicle 300 traverses the track section 180 of the toy vehicle booster 100. This alignment, as well as the overall alignment of the toy vehicle 300 with respect to the track section 180 may be facilitated, in at least some embodiments, by the grooves 322 of the chassis 320. As can be seen in FIGS. 11 and 12, the grooves 322 may engage and slide along (or otherwise translate along) the central wall 190 as the toy vehicle 300 moves through the track section 180 to align the main body 301 with gap G.

Figure 14:
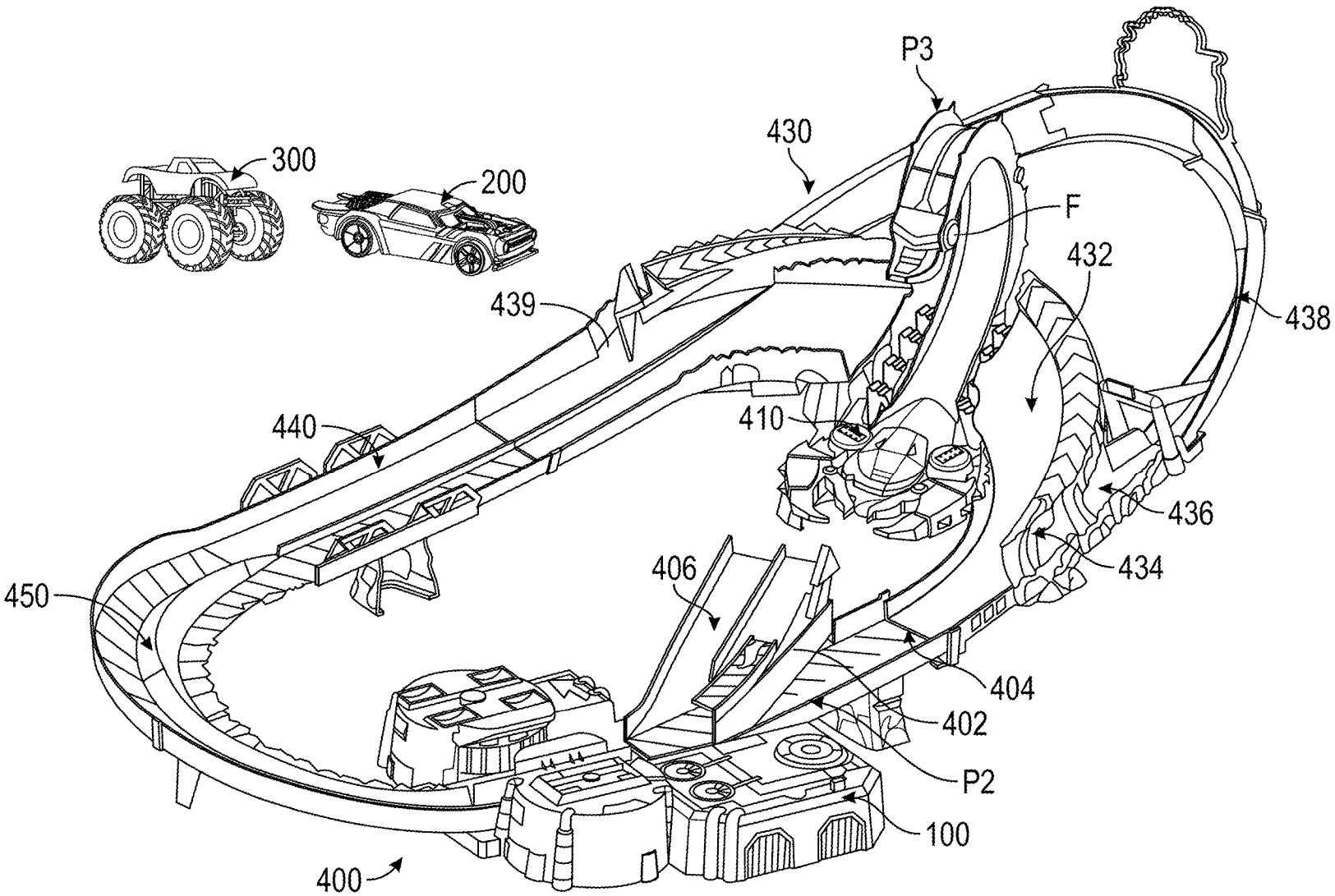
FIG. 14 illustrates a top perspective view of a toy vehicle track set that includes the toy vehicle booster of FIG. 1.

FIG. 14 illustrates a track set 400 that includes booster 100. Advantageously, since the booster 100 can accommodate and accelerate toy vehicles of a first size, such as toy vehicle 200, and toy vehicles of a second, larger size, such as toy vehicle 300, the track set 400 can include new and interesting play features for vehicles of two sizes. For example, the depicted embodiment includes a stunt element 410 that interacts with the toy vehicle 200 and the toy vehicle 300 as well as a two-car curve 430 that provides different pathways for toy vehicle 200 and toy vehicle 300. Additionally, the track set 400 includes a diverter 402, a double lane straight track 440, and a double lane curved track 450 to provide travel paths between the toy vehicle booster 100, the stunt element 410, and the two-car curve 430 for both toy vehicle 200 and toy vehicle 300. Collectively, these track segments form a closed loop between an entrance of the booster 100 and an exit of booster 100.

The diverter 402 is disposed at the second end 184 (e.g., the exit end) of the toy vehicle booster 100 and provides a first exit 404 and a second exit 406. The first exit 404 directs toy vehicles exiting the booster 100, whether toy vehicle 200 or toy vehicle 300, towards the two-car curve 430. The first exit 404 is a wide, single lane track 420 with opposing sidewalls 422 and no central wall, but the opposing sidewalls 422 are separated by enough space to allow the toy vehicle 200 (which has an overall width W5) or toy vehicle 300 (which has an overall width W6) to travel between the sidewalls 422. Meanwhile, the second exit 406 directs toy vehicles exiting the booster 100, whether toy vehicle 200 or toy vehicle 300, through the air towards the stunt element 410. That is, second exit 406 is a jump. The second exit 406 may include a central wall like the double lane straight track 440, which is described in further detail below. When the diverter 402 is in a first position P1 (see FIG. 15), the diverter 402 directs toy vehicles 200 and/or 300 to the first exit 404. When the diverter 402 is in a second position (see FIG. 14), the diverter 402 directs toy vehicles 200 and/or 300 to the second exit 406.

Figure 15:
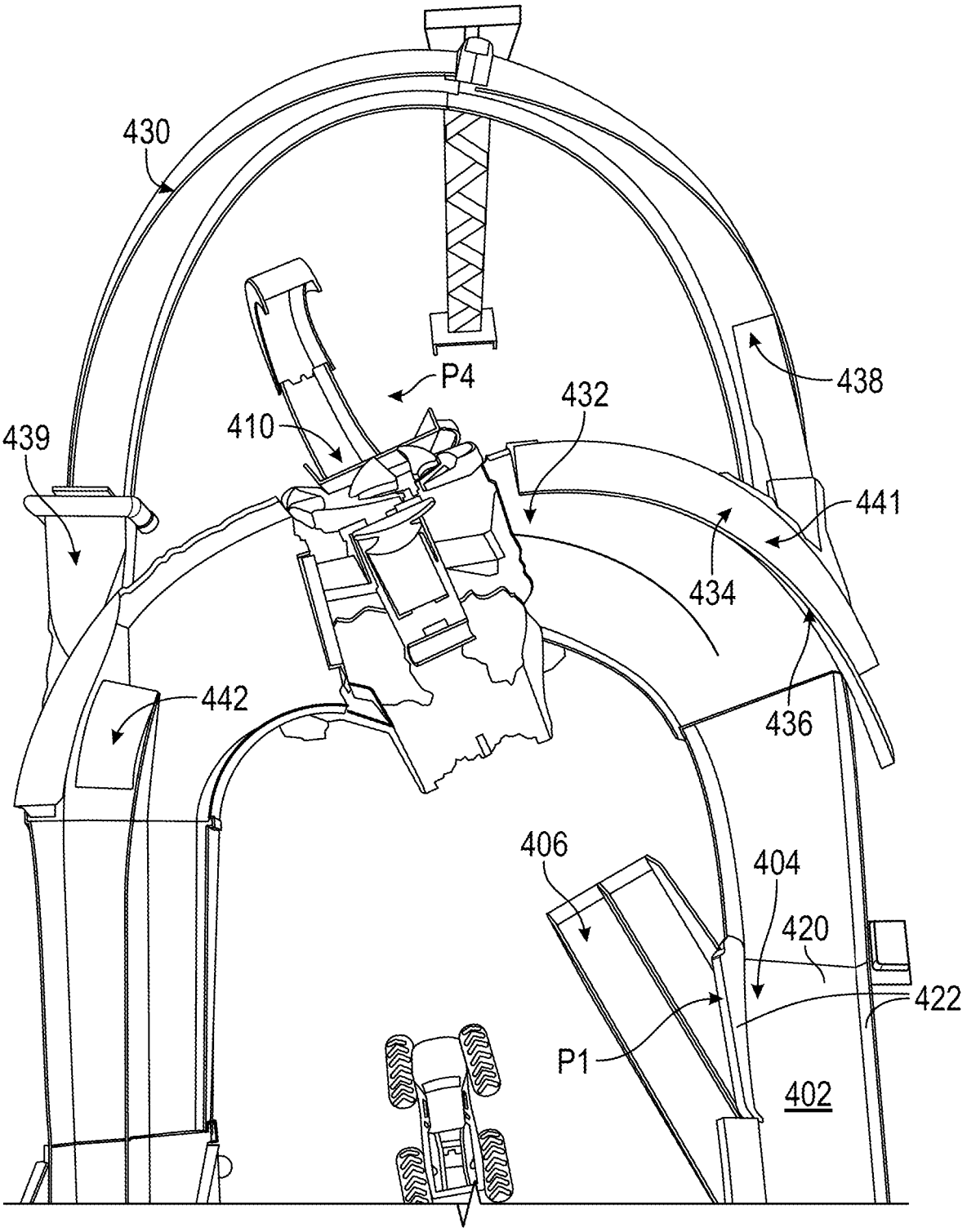
FIG. 15 illustrates a close-up perspective view of a turn included in the toy vehicle track set of FIG. 14
Figure 16:
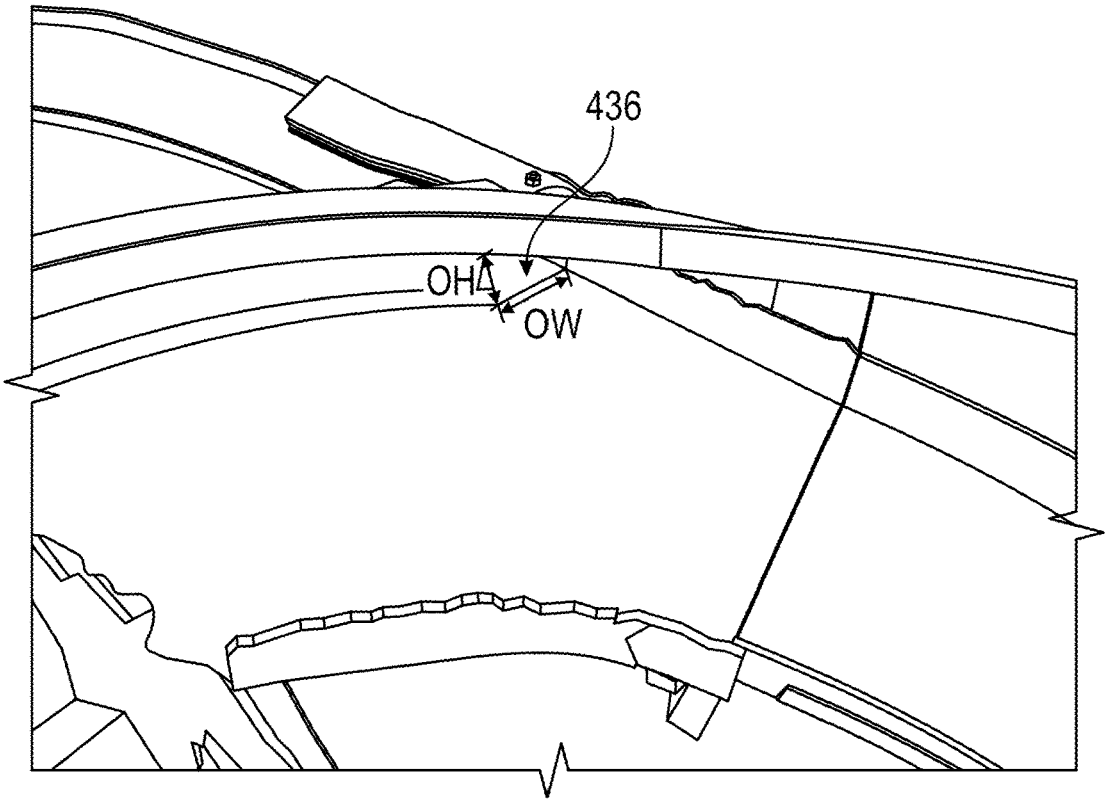
FIGS. 16 and 17 illustrate close-up perspective views of a portion of the turn shown in FIG. 15.
Figure 17:
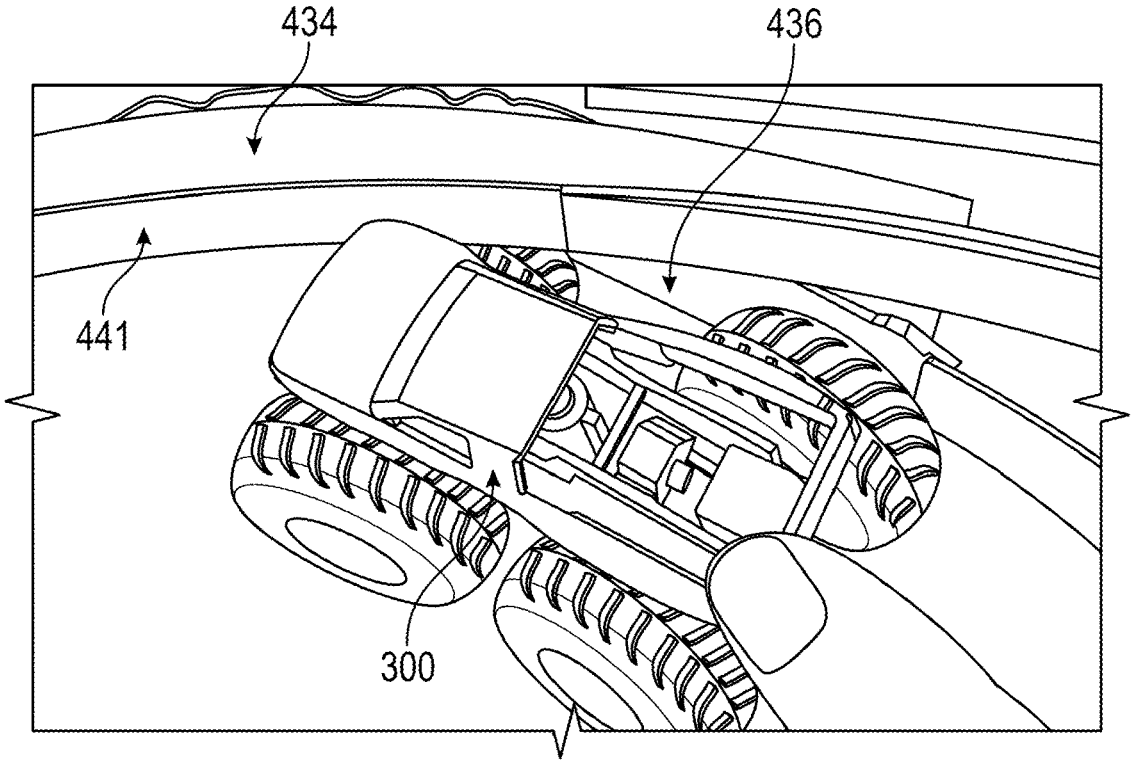

Now turning to FIGS. 15-17, but with continued reference to FIG. 14 as well, the two-car curve 430 includes a first pathway 432 and a second pathway 438. The first pathway 432 is sized for larger scale/sized toy vehicles 300 (but could also accommodate smaller scale/size toy vehicles 200) and the second pathway 438 is sized for smaller scale/size toy vehicles 200. To sort the vehicles into the correct path, the two-car curve 430 includes a guard rail 434 with an exit opening 436 that is sized to allow smaller scale/size toy vehicles 200 to pass therethrough while preventing larger scale/size toy vehicles 300 from passing therethrough. In the depicted embodiment, the exit opening 436 achieves this filtering because the exit opening 436 has dimensions smaller than the overall dimensions of the larger scale/size toy vehicle 300. That is, the exit opening 436 has a height "OH" smaller than the overall height H6 of toy vehicle 300 and/or has a width "OW" smaller than the overall width W6 of the toy vehicle 300.

Once a toy vehicle 200 exits the two-car curve 430 at the exit opening 436, the toy vehicle 200 travels along the second pathway 438 until re-entering the two-car curve 430 through an entrance opening 439, which may have similar dimensions to the exit opening 436. Meanwhile, larger scale/size toy vehicles 300 may traverse the first pathway 432 and may jump or engage the stunt element 410. Thus, in some instances, the two-car curve 430 may create new and interesting play/race features in the form of collisions between larger scale/size toy vehicle 300 traveling along the first pathway 432 and smaller scale/size toy vehicle 200 reentering the two-car curve 430 via the entrance opening 439.

The guard rail 434 further includes a lateral extension 441 that helps the larger scale/size toy vehicles 300 turn along the two-car curve 430 by retaining and encouraging the wheels 310 of the toy vehicle 300 to remain in contact with the track surface (see FIG. 17). Furthermore, the lateral extension 441 is positioned at a height such that it covers a portion of the wheels 310 but is still able to contact the main body 301 of the toy vehicle 300. As the toy vehicle 300 approaches and contacts the guard rail 434, the main body 301 contacts the lateral extension 441 and tilts, which causes the toy vehicle 300 to turn along the curve.

Figure 18:
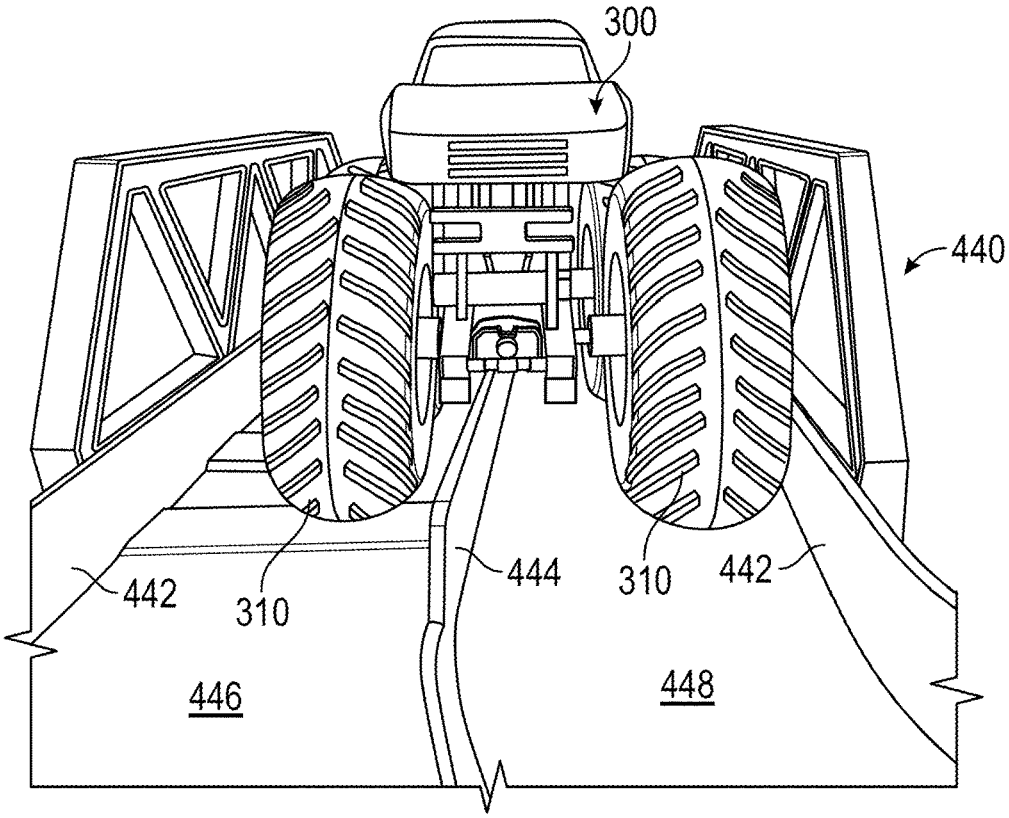
FIGS. 18 and 19 illustrate a straight portion of track and a curved portion of track, respectively, included in the track set of FIG. 14.
Figure 19:
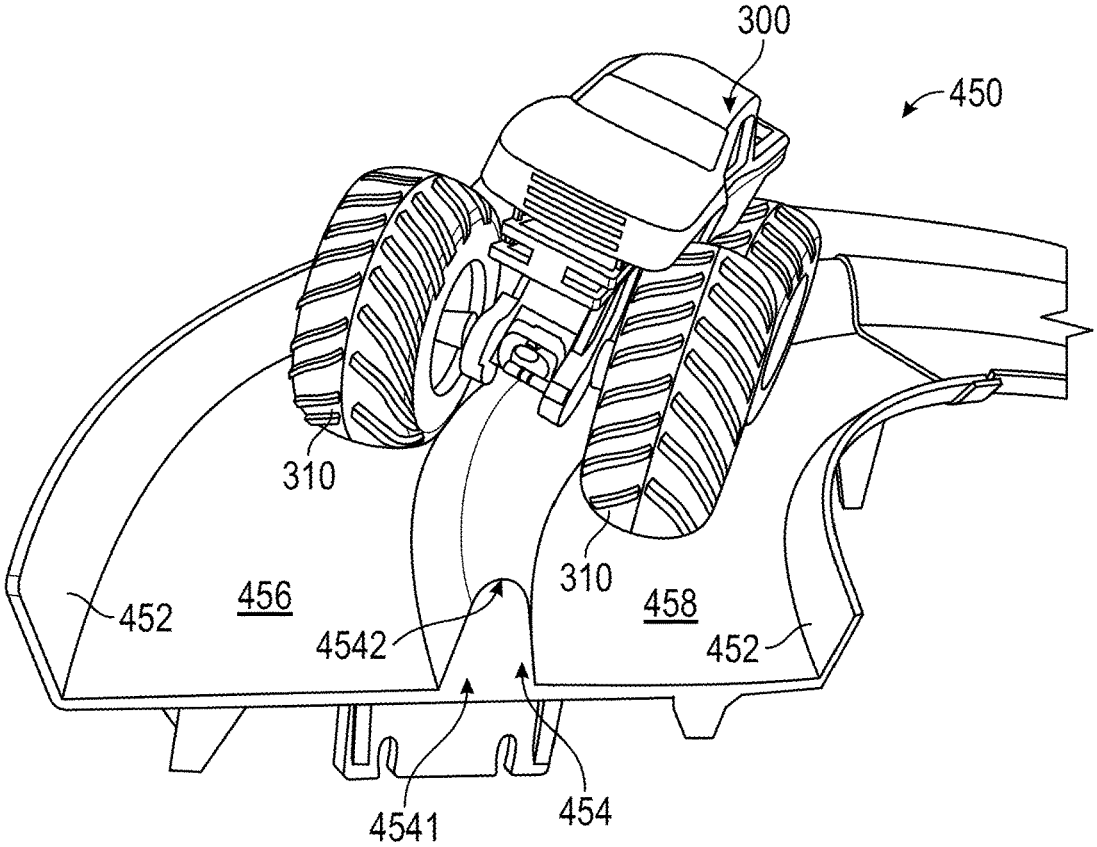

Now turning to FIGS. 18 and 19, but with continued reference to FIG. 14 as well, after exiting the two-car curve 430, a toy vehicle 200 or a toy vehicle 300 may travel along the double lane straight track 440 and the double lane curved track 450 to return to the toy vehicle booster 100. The double lane straight track 440 has sidewalls 442 and a central wall 444 disposed therebetween. The central wall 444 is substantially straight and, in this particular embodiment, divides the double lane straight track 440 into a first track 446 and a second track 448 of equal dimensions. The first track 446 and the second track 448 are each sized to receive an entire toy vehicle 200 or wheels 310 disposed on one side of the toy vehicle 300, similar to the first track pathway 196 and the second track pathway 198 of the track section 180 of toy vehicle booster 100.

By comparison, the double lane curved track 450 has flared or cambered opposing sidewalls 452 and a tapered central wall 454 that is wider at is base 4541 and tapers to a narrower apex 4542. The central wall 454 and sidewalls 452 still define two track pathways, first track 456 and second track 458, which are each sized to receive an entire toy vehicle 200 or wheels 310 disposed on one side of the toy vehicle 300, similar to the first track pathway 196 and the second track pathway 198 of the track section 180 of toy vehicle booster 100; however, since the sidewalls 452 are flared and the central wall 454 is tapered, the double lane curved track 450 allows smaller scale/size toy vehicles 200, as well as larger scale/size toy vehicle 300, to tilt or lean into the turn.

Now turning back to FIG. 14, if the diverter 402 is in its second position P2, the diverter 402 may launch toy vehicles 300 or toy vehicles 200 towards stunt element 410. When the stunt element 410 is in its non-actuated position P3, smaller scale/size toy vehicles 200 can land on the stunt element 410 and travel up and around a track provided thereon so that the toy vehicle 200 can fall on top of the stunt element 410. Meanwhile, a user can try to land larger scale/size toy vehicles 300 directly atop of the stunt element 410 when the stunt element 410 is in position P3. When a toy vehicle 200 or a toy vehicle 300 lands atop the stunt element 410, it may pivot partially upwards. Another toy vehicle 200 or toy vehicle 300 can then hit the partially pivoted stunt element 410 to further cause it to pivot to a fully actuated position P4 (see FIG. 15). In another instance, the stunt element 410 pivots partially upwards from position P3 into the first pathway 432 of the two-car curve 430. Once the stunt element 410 is positioned in the first pathway 432, a toy vehicle 300 traveling along the first pathway 432 can hit the stunt element 410 laterally to cause the stunt element 410 to move to the fully actuated position P4. In both instances, the element 410 is essentially removed from play. Thus, the stunt element 410 may allow a toy vehicle 200 and a toy vehicle 300 to cooperate to overcome a stunt, which may be new and interesting to users that typically use vehicles of one size with a track set.

Alternatively, in some instances, the two-car curve 430 may include a switch 442 (see FIG. 15) that actuates the stunt element 410 to pivot from its non-actuated position P3 slightly upwards. The switch 442 is depressed each time a toy vehicle 200 or toy vehicle 300 travels along the two-car curve 430, which causes the stunt element 410 to temporarily pivot upwards. This creates a racing challenge where a toy vehicle 300 may be knocked off the first pathway 432 by the element 410. To knock the larger scale/size toy vehicle 300 off the first pathway 432, a toy vehicle 200 must actuate the switch precisely when the toy vehicle 300 is attempting to jump the stunt element 410 while traveling along the first pathway 432. Thus, again, the stunt element 410 may allow interplay between a toy vehicle 200 of a first size/scale and a toy vehicle 300 of second size/scale, which may be new and interesting to users that typically use vehicles of one size with a track set.

While the toy vehicle booster presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicle booster described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A toy vehicle booster, comprising:

a track section with a central wall that defines a first pathway and a second pathway that are each sized to receive a toy vehicle of a first width, wherein the track section has an overall width sized to receive another toy vehicle of a second width, the second width being larger than the first width;

a booster assembly with a first booster wheel and a second booster wheel positioned on opposite sides of the track section so that the first booster wheel can act on a first toy vehicle of the first width traveling along the first pathway and the second booster wheel can act on a second toy vehicle of the first width traveling along the second pathway;

a first track covering that extends over the track section above the first booster wheel; and a second track covering that extends over the track section above the second booster wheel;

wherein the first track covering is laterally separated from the second track covering by a gap that is wider than the second width of said another toy vehicle so that said another toy vehicle can travel along the first pathway and the second pathway simultaneously.

2. The toy vehicle booster of claim 1, wherein the first booster wheel can act on the first toy vehicle by compressing the first toy vehicle against the central wall to impart rotational force to the first toy vehicle and the second booster wheel can act on the second toy vehicle by compressing the second toy vehicle against the central wall to impart rotational force to the second toy vehicle.

3. The toy vehicle booster of claim 1, wherein the first pathway and the second pathway are parallel pathways.

4. The toy vehicle booster of claim 1, further comprising:

a booster housing that defines at least a width of the track section.

5. The toy vehicle booster of claim 4, wherein the booster housing comprises:

a first booster housing that houses at least a portion of the first booster wheel and includes a first inner side wall with a first opening that allows the first booster wheel to extend into the track section; and a second booster housing that houses at least a portion of the second booster wheel and includes a second inner side wall with a second opening that allows the second booster wheel to extend into the track section, wherein the first inner side wall and the second inner side wall define the width of the track section.

6. The toy vehicle booster of claim 1, wherein the first track covering and the second track covering are vertically spaced from the track section by a height that is larger than a height of the first and second toy vehicles and larger than a diameter of wheels of said another toy vehicle.

7. The toy vehicle booster of claim 1, wherein the first booster wheel and the second booster wheel are linked booster wheels that operate at the same speed.

8. A toy vehicle booster, comprising:

a track section configured to receive a first toy vehicle of a first size and a second toy vehicle of a second size, the second size being larger than the first size;

a booster assembly with a first booster wheel and a second booster wheel positioned on opposite sides of the track section, wherein one of the first booster wheel and the second booster wheel acts on the first toy vehicle to accelerate the first toy vehicle through the toy vehicle booster and both the first booster wheel and the second booster wheel act on the second toy vehicle to accelerate the second toy vehicle through the toy vehicle booster;

a first track covering that extends over the track section above the first booster wheel; and a second track covering that extends over the track section above the second booster wheel, wherein the first toy vehicle travels beneath the first track covering or the second track covering when traversing the track section, and when the second toy vehicle traverses the track section, wheels of the second toy vehicle travel beneath the first track covering and the second track covering and a main body of the second toy vehicle travels between the first track covering and the second track covering.

9. The toy vehicle booster of claim 8, wherein the track section includes a central wall that defines a first pathway and a second pathway, each of which are sized to receive the first toy vehicle.

10. The toy vehicle booster of claim 8, further comprising:

a first booster housing that houses at least a portion of the first booster wheel and includes a first inner side wall with a first opening that allows the first booster wheel to extend into the track section; and a second booster housing that houses at least a portion of the second booster wheel and includes a second inner side wall with a second opening that allows the second booster wheel to extend into the track section, wherein the first inner side wall and the second inner side wall define a width of the track section.

11. The toy vehicle booster of claim 8, wherein the first toy vehicle comprises a 1:64 scale production vehicle and the second toy vehicle comprises a 1:64 scale monster truck.

12. A toy vehicle play set, comprising:

a first toy vehicle of a first size;

a second toy vehicle of a second size that is larger than the first size; and a toy vehicle booster with a first booster wheel and a second booster wheel positioned on opposite sides of a track section, wherein one of the first booster wheel and the second booster wheel acts on the first toy vehicle to accelerate the first toy vehicle through the toy vehicle booster and both the first booster wheel and the second booster wheel act on the second toy vehicle to accelerate the second toy vehicle through the toy vehicle booster, wherein when the second toy vehicle traverses the track section, a main body of the second toy vehicle travels between a first track covering and a second track covering.

13. The toy vehicle play set of claim 12, further comprising:

one or more track segments that form a closed loop between an entrance of the toy vehicle booster and an exit of the toy vehicle booster, wherein at least one of the one or more track segments includes a central wall that defines two pathways that are individually sized to receive the first toy vehicle and collectively sized to receive the second toy vehicle.

14. The toy vehicle play set of claim 12, further comprising:

a track segment with an overall width sized to receive the second toy vehicle and an exit opening sized to receive the first toy vehicle, the exit opening allowing the first toy vehicle to escape, at least temporarily, the track segment.

15. The toy vehicle play set of claim 14, wherein the track segment further includes a guard rail defining the exit opening, the guard rail configured to guide the second toy vehicle along the track segment.

* * * * *